US009706604B2

(12) United States Patent
Kumazawa

(10) Patent No.: US 9,706,604 B2
(45) Date of Patent: Jul. 11, 2017

(54) HEATER

(71) Applicant: KYOCERA Corporation, Kyoto-shi, Kyoto (JP)

(72) Inventor: Sadaomi Kumazawa, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 133 days.

(21) Appl. No.: 14/654,132

(22) PCT Filed: Dec. 20, 2013

(86) PCT No.: PCT/JP2013/084270

§ 371 (c)(1),
(2) Date: Jun. 19, 2015

(87) PCT Pub. No.: WO2014/098225

PCT Pub. Date: Jun. 26, 2014

(65) Prior Publication Data

US 2015/0334776 A1 Nov. 19, 2015

(30) Foreign Application Priority Data

Dec. 21, 2012 (JP) ..... 2012-279431

(51) Int. Cl.
*H05B 3/16* (2006.01)
*H05B 3/44* (2006.01)
(Continued)

(52) U.S. Cl.
CPC ..... *H05B 3/0014* (2013.01); *H05B 3/18* (2013.01); *H05B 3/48* (2013.01); *H05B 2203/027* (2013.01)

(58) Field of Classification Search
CPC .. H05B 2203/027; H05B 3/0014; H05B 3/18; H05B 3/20; H05B 3/40–3/48
(Continued)

(56) References Cited

U.S. PATENT DOCUMENTS 6,348,273 B1 * 2/2002 Ishikawa ..... B23K 35/286 428/403
7,049,929 B1 * 5/2006 Fjelstad ..... H01C 7/005 338/252
2010/0288746 A1 * 11/2010 Takenouchi ..... H05B 3/141 219/209

FOREIGN PATENT DOCUMENTS

CN 1870839 A 11/2006
JP 09-148053 A 6/1997
(Continued)

OTHER PUBLICATIONS

Korean Office Action with English concise explanation, Korean Patent Application No. 10-2015-7015850, Aug. 16, 2016, 5 pgs.
(Continued)

*Primary Examiner* — Sang Y Paik
(74) *Attorney, Agent, or Firm* — Volpe and Koenig, P.C.

(57) ABSTRACT

A heater includes a ceramic structure; a heat-generating resistor embedded in the ceramic structure; a conductor line connected to the heat-generating resistor; a through-hole conductor having one end connected to the conductor line and the other end led out to a surface of the ceramic structure; and an electrode pad disposed on the surface of the ceramic structure so as to cover the through-hole conductor, the electrode pad being connected to the through-hole conductor. The through-hole conductor has a protrusion which protrudes outwardly beyond the surface of the ceramic structure.

8 Claims, 6 Drawing Sheets

(51) Int. Cl.
*H05B 3/00* (2006.01)
*H05B 3/18* (2006.01)
*H05B 3/48* (2006.01)

(58) Field of Classification Search
USPC ..... 219/544, 546–548
See application file for complete search history.

(56) References Cited

FOREIGN PATENT DOCUMENTS

| | | | |
|---|---|---|---|
| JP | 11-273837 | A | 10/1999 |
| JP | 2000-340349 | A | 12/2000 |
| JP | 2011-029088 | A | 2/2011 |

OTHER PUBLICATIONS

International Search Report, PCT/JP2013/084270, Feb. 10, 2014, 1 pg.
Chinese Office Action with English concise explanation, Chinese Patent Application No. 201380065227.8, Dec. 15, 2015, 7 pgs.

* cited by examiner

HEATER

TECHNICAL FIELD

The present invention relates to a heater for use in, for example, hair irons, heaters for water heating, oxygen sensors, air-fuel ratio sensors, glow plugs, and semiconductor manufacturing apparatuses.

BACKGROUND ART

As an example of heaters for use in the hair iron mentioned above or the like, a ceramic heater is disclosed in Japanese Unexamined Patent Publication JP-A 11-273837 (1999) (hereafter referred to as "Patent Literature 1"). The ceramic heater disclosed in Patent Literature 1 comprises: a ceramic substrate; a heater section disposed within the ceramic substrate; a lead section disposed within the ceramic substrate so as to be connected to the heater section; and an electrically conductive layer attached to the ceramic substrate, in which one end thereof is connected to the lead section and the other end thereof is led out to a surface of the ceramic substrate.

In the ceramic heater (hereafter also referred to simply as "heater") disclosed in Patent Literature 1, however, heat generated in the heater section (heat-generating resistor) may be transmitted, through the lead section (conductor line), to a conductor layer (through-hole conductor). The heat trapped in the through-hole conductor may cause a thermal stress between the through-hole conductor and the ceramic substrate (ceramic structure). This makes it difficult to enhance the long-term reliability of the heater.

SUMMARY OF INVENTION

A heater according to an aspect of the invention comprises: a ceramic structure; a heat-generating resistor embedded in the ceramic structure; a conductor line embedded in the ceramic structure so as to be connected to the heat-generating resistor; a through-hole conductor disposed in the ceramic structure, one end of the through-hole conductor being connected to the conductor line and the other end of the through-hole conductor being led out to a surface of the ceramic structure; and an electrode pad disposed on the surface of the ceramic structure so as to cover the through-hole conductor, the electrode pad being connected to the through-hole conductor, the through-hole conductor having a protrusion which protrudes outwardly beyond the surface of the ceramic structure.

DESCRIPTION OF EMBODIMENTS

Hereinafter, a heater according to one embodiment of the invention will be described in detail with reference to drawings.

Figure 1:
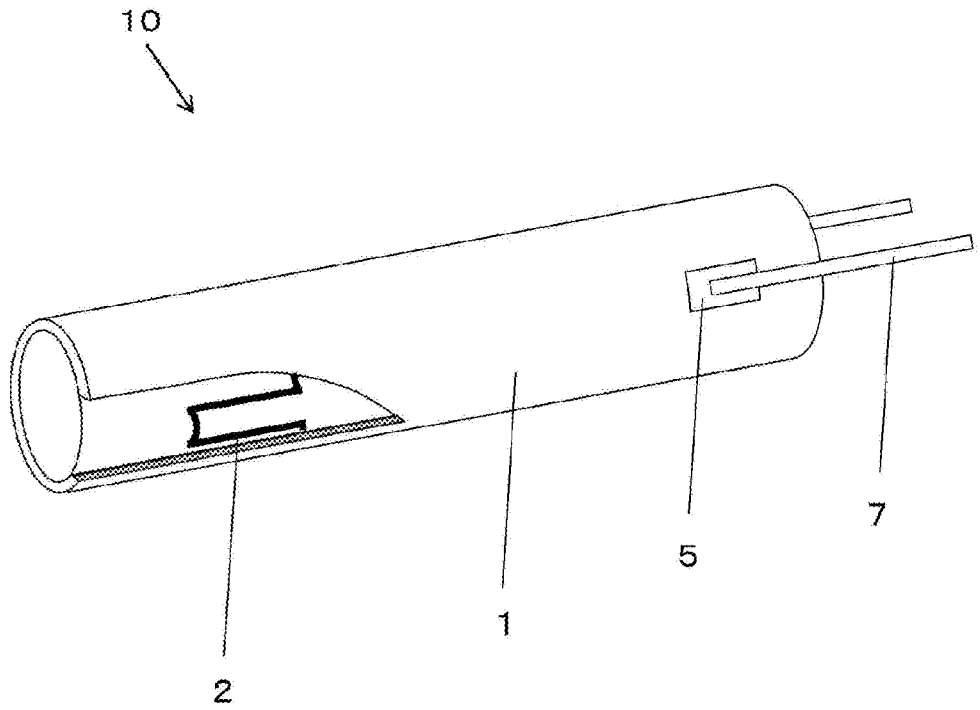
FIG. 1 is a perspective view, partially broken away, of a heater according to one embodiment of the invention.
Figure 2:
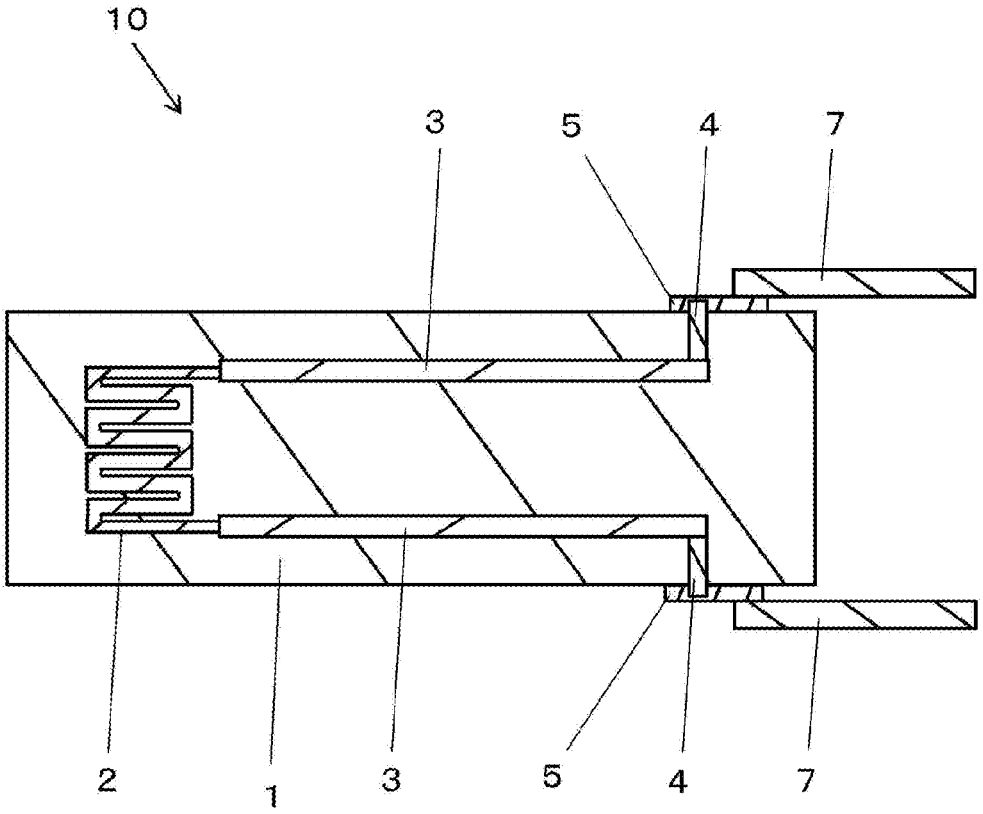
FIG. 2 is view schematically showing the heater according to one embodiment of the invention.

FIG. 1 is a perspective view, partially broken away, of a heater 10 according to one embodiment of the invention. FIG. 2 is a view schematically showing the heater 10 according to one embodiment of the invention. As shown in FIG. 2, the heater 10 according to one embodiment of the invention comprises: a ceramic structure 1; a heat-generating resistor 2; a conductor line 3; a through-hole conductor 4, and an electrode pad 5. The heater 10 is used for, for example, hair irons, heaters for water heating, oxygen sensors, air-fuel ratio sensors, glow plugs, and semiconductor manufacturing apparatuses.

<Constitution of Ceramic Structure 1>

The ceramic structure 1 is a member for holding the heat-generating resistor 2 and the conductor line 3 therein-side. The heat-generating resistor 2 and the conductor line 3 placed within the ceramic structure 1 are capable of exhibiting higher environmental resistance. The ceramic structure 1 is a rod-like member. The ceramic structure 1 is a cylindrical member. The ceramic structure 1 is composed of a plurality of ceramic layers. More specifically, in the ceramic structure 1, a rod-like ceramic element is located centrally, and a plurality of ceramic layers are laminated so as to be disposed around an outer peripheral surface of the ceramic element. The heat-generating resistor 2 and the conductor line 3 are located between a plurality of the ceramic layers. The ceramic structure 1 is made of a ceramic material such as alumina, silicon nitride, aluminum nitride, or silicon carbide. For example, the ceramic structure 1 has an outer diameter of 1 to 30 mm, and a longitudinal length of 5 to 200 mm.

<Constitution of Heat-Generating Resistor 2>

The heat-generating resistor 2 is a member for heat production. The heat-generating resistor 2 is embedded in the ceramic structure 1 so as to be located between the plurality of ceramic layers. The heat-generating resistor 2 extends along an outer peripheral surface of the ceramic structure 1. The heat-generating resistor 2 lies over a wide range in the form of a plurality of turned-back portions. The heat-generating resistor 2 is made of a metal material. The heat-generating resistor 2 is preferably made of a metal material which can be simultaneously fired together with the ceramic structure 1. Examples of the metal material which can be simultaneously fired together with the ceramic structure 1 include tungsten, molybdenum, and rhenium. For example, the heat-generating resistor 2 has a width of 0.1 to 5 mm, and a thickness of 0.01 to 1 mm. Heat liberated by the heat-generating resistor 2 is transmitted through the interior of the ceramic structure 1 and radiates from the surface of the ceramic structure 1.

<Constitution of Conductor Line 3>

The conductor line 3 is a member for providing, in conjunction with the through-hole conductor 4 and the electrode pad 5, electrical connection between the heat-generating resistor 2 and a power supply (not shown) external to the ceramic structure 1. The conductor line 3 is embedded in the ceramic structure 1. The conductor line 3 is located in the same ceramic layer-to-ceramic layer region where the heat-generating resistor 2 is disposed. One end of the conductor line 3 is electrically connected to an end of the heat-generating resistor 2 and the other end of the conductor line 3 is connected to the through-hole conductor 4 for making connection with the external power supply. The conductor line 3 is preferably made of a metal material which can be simultaneously fired together with the ceramic structure 1. Examples of the metal material which can be simultaneously fired together with the ceramic structure 1 include tungsten, molybdenum, and rhenium. For example, the conductor line 3 has a width of 0.1 to 2 mm, and a thickness of 1 to 100 μm.

<Constitution of Through-Hole Conductor 4>

Figure 3:
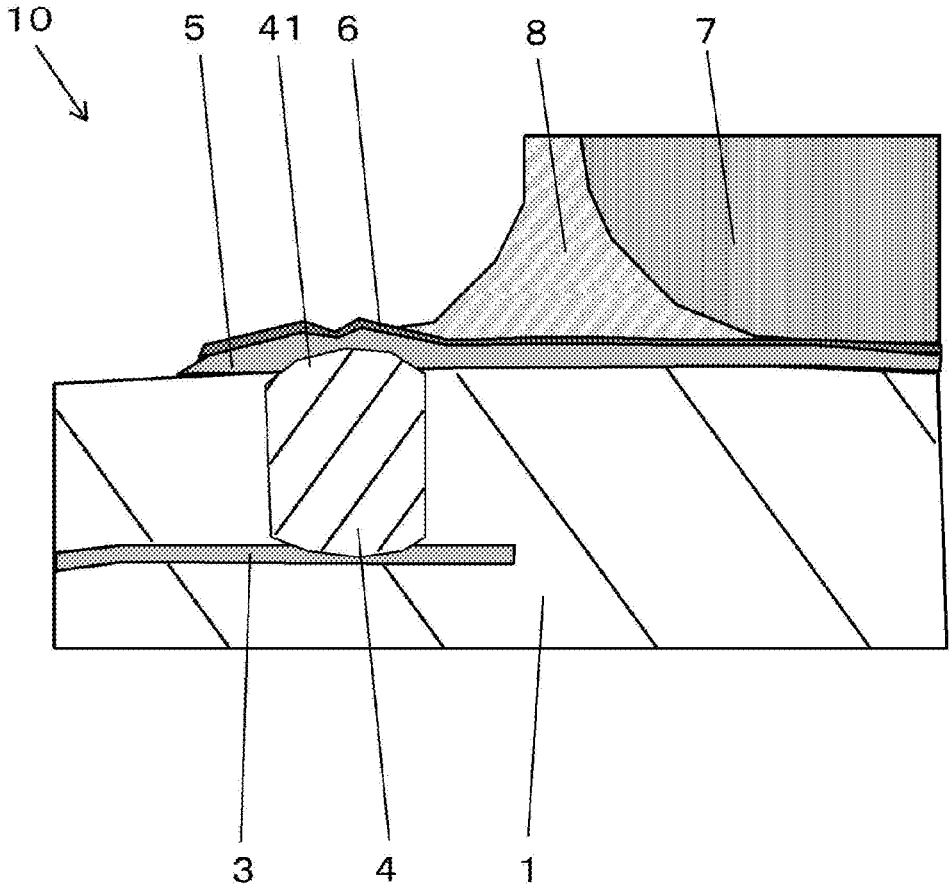
FIG. 3 is an enlarged fragmentary view of the heater according to one embodiment of the invention, illustrating a through-hole conductor and nearby areas.

The through-hole conductor 4 is a member for providing electrical connection between the conductor line 3 and the electrode pad 5. The through-hole conductor 4 is disposed in the ceramic structure 1. One end of the through-hole conductor 4 is connected to the conductor line 3 and the other end thereof is led out to the surface of the ceramic structure 1. Moreover, as shown in FIG. 3, the other end of the through-hole conductor 4 is covered with the electrode pad 5, thus enabling electrical connection with the electrode pad 5. FIG. 3 is an enlarged fragmentary view showing the through-hole conductor 4 and nearby areas. The through-hole conductor 4 is preferably made of a metal material which can be simultaneously fired together with the ceramic structure 1. Examples of the metal material which can be simultaneously fired together with the ceramic structure 1 include tungsten, molybdenum, and rhenium.

The through-hole conductor 4 has a protrusion 41 at the other end thereof. The protrusion 41 protrudes outwardly beyond the surface of the ceramic structure 1. More specifically, the protrusion 41 extends in the shape of a dome from the surface of the ceramic structure 1. This makes it possible to increase the area of contact between the through-hole conductor 4 and the electrode pad 5, and thereby facilitate dissipation of heat from the through-hole conductor 4 to outside. Thus, even if heat liberated by the heat-generating resistor 2 is transmitted, through the conductor line 3, to the through-hole conductor 4, the heat trapped in the through-hole conductor 4 can be reduced. This makes it possible to prevent an excessive temperature rise in the through-hole conductor 4, and thereby reduce a thermal stress developed between the through-hole conductor 4 and the ceramic structure 1. Consequently, it is possible to reduce the possibility of cracking of the through-hole conductor 4 and the ceramic structure 1, and therefore the long-term reliability of the heater 10 can be enhanced.

The through-hole conductor 4 is cylindrically shaped. In the cylindrical through-hole conductor 4, concentration of thermal stress on a certain part of the through-hole conductor 4 can be reduced. In a case where the through-hole conductor 4 is cylindrical, as to dimensions of the through-hole conductor 4, for example, the outer diameter of the through-hole conductor 4 can be set in the range of 0.1 to 1 mm. Moreover, given that the outer diameter is 0.1 mm, then the entire length of the through-hole conductor 4 including the protrusion 41 can be set in the range of about 0.1 to 1 mm, for example. In this case, the length of a protruding portion (protrusion 41) of the through-hole conductor 4 can be set in the range of about 0.003 mm to 0.1 mm, for example. By setting the length of the protrusion 41 to be greater than 0.003 mm, it is possible to increase the area of contact between the through-hole conductor 4 and the electrode pad 5. Thus, heat can be readily dissipated outwardly from the through-hole conductor 4. Moreover, by setting the length of the protrusion 41 to be smaller than 0.1 mm, it is possible to reduce the possibility that the protrusion breaks when external force is applied to the protrusion.

A surface of the protrusion 41 is a curved surface in which a central part of the protrusion surface projects outwardly. When the protrusion 41 has the curved surface, it is possible to reduce generation of noise in the protrusion 41. More specifically, in a case where the surface of the protrusion 41 has a sharp-pointed part, the energy of electric current flowing between the through-hole conductor 4 and the electrode pad 5 may be concentrated on the tip of the pointed part of the protrusion 41, which leads to occurrence of spark. This may cause generation of noise in the protrusion 41. By curving the surface of the protrusion 41, it is possible to reduce generation of noise. By reducing generation of noise, it is possible to lessen the adverse effect of noise upon an electronic component installed around the heater 10.

Moreover, a surface of the through-hole conductor 4 at one end thereof which surface is connected to the conductor line 3 is a curved surface protruding downwardly (toward the conductor line 3). By making the surface connected to the conductor line 3 as a curved surface, it is possible to reduce noise generation at the connected surface. More specifically, in a case where the connected surface has a sharp-pointed part, the energy of electric current flowing between the through-hole conductor 4 and the conductor line 3 may be concentrated on the tip of the pointed part of the connected surface, which leads to occurrence of spark. This may cause generation of noise. By curving the connected surface, it is possible to reduce generation of noise. By reducing generation of noise, it is possible to lessen the adverse effect of noise upon an electronic component installed around the heater 10.

<Constitution of Electrode Pad 5>

The electrode pad 5 is a member for providing electrical connection between the through-hole conductor 4 and the external power supply. The electrode pad 5 is disposed on the surface of the ceramic structure 1. The electrode pad 5 adherently covers the protrusion 41 of the through-hole conductor 4. Thus, the electrode pad 5 is electrically connected to the through-hole conductor 4. A rod-like lead terminal 7 is joined to the electrode pad 5 so as to extend therefrom toward a side of the heater opposite a side bearing the heat-generating resistor 2. The lead terminal 7 is made of a metal material having excellent electrical conductivity, for example, nickel. For example, a brazing material 8 is used to join the electrode pad 5 to the lead terminal 7. For example, silver solder is used as the brazing material 8. The brazing material 8 extends from a region of the electrode pad 5 in which the lead terminal is disposed, to a region of the electrode pad 5 in which the through-hole conductor 4 is covered. In the heater 10 of the present embodiment, the thermal stress developed between the through-hole conductor 4 and the ceramic structure 1 is reduced, wherefore the possibility of deformation of the through-hole conductor 4 is reduced. Thus, the possibility of separation between the electrode pad 5 and the through-hole conductor 4 is reduced. This helps diminish the possibility that a stress will be developed between the electrode pad 5 and the brazing material 8 due to deformation of the electrode pad 5 caused by separation between the electrode pad 5 and the through-hole conductor 4. As a result, the possibility of cracking of the brazing material 8 is reduced. Thus, the possibility of separation of the lead terminal 7 is also reduced. Consequently, long-term reliability of the heater 10 can be enhanced.

A plating layer 6 is disposed on an upper surface of the electrode pad 5. For example, a nickel plating layer can be used as the plating layer 6. By providing the nickel plating layer, it is possible to increase the degree of adhesion between the electrode pad 5 and the lead terminal 7.

Moreover, the protrusion 41 of the through-hole conductor 4 is buried into the electrode pad 5. More specifically, the electrode pad 5 is partly recessed, so that the protrusion 41 of the through-hole conductor 4 is situated in this recess. By burying the protrusion 41 into the electrode pad 5, it is possible to restrain the electrode pad 5 from being displaced in a direction along the surface of the ceramic structure 1. Consequently, it is possible to further reduce the possibility of separation of the electrode pad 5.

The electrode pad 5 is preferably made of a metal material which can be simultaneously fired together with the ceramic structure 1. Examples of the metal material which can be simultaneously fired together with the ceramic structure 1 include tungsten, molybdenum, and rhenium. As to dimensions of the electrode pad 5, for example, the width of the electrode pad 5 can be set in the range of 0.5 to 15 mm. Given that the width is about 0.5 mm, then the length of the electrode pad 5 can be set at 0.5 mm, for example. Moreover, given that the width is about 15 mm, then the length can be set at about 20 mm.

Figure 4:
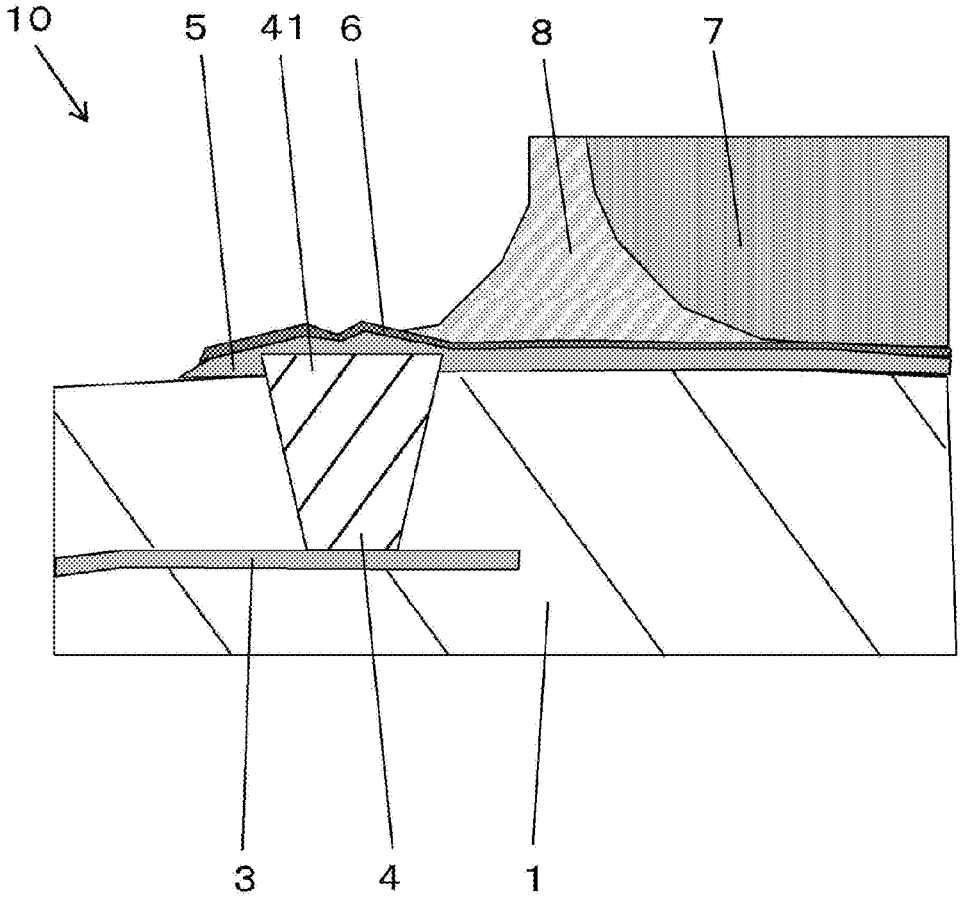
FIG. 4 is an enlarged fragmentary view of the heater according to a modified example of the invention.

It should be understood that the invention is not limited to the embodiments described above, and thus many changes and modifications may be made therein without departing from the scope of the invention. For example, in the heater 10 shown in FIG. 4 according to a modified example of the invention, an outer periphery of the protrusion 41 of the through-hole conductor 4 widens gradually as the protrusion 41 protrudes outwardly. In this case, the electrode pad 5 extends inside an area below a widened portion of the protrusion 41, and the widened portion of the protrusion 41 is thus held between upper and lower parts of the electrode pad 5. This makes it possible to fix the electrode pad 5 to the through-hole conductor 4 more securely.

Figure 5:
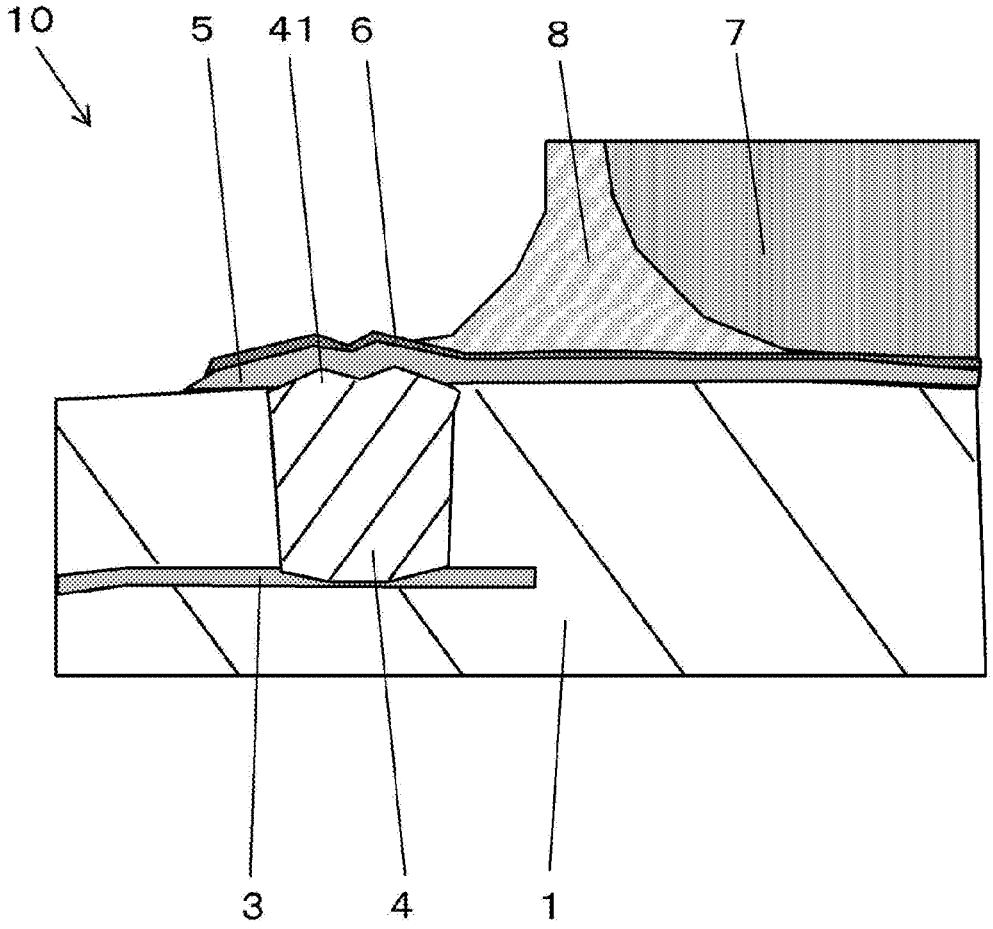
FIG. 5 is an enlarged fragmentary view of the heater according to a modified example of the invention.

Moreover, in the heater 10 shown in FIG. 5 according to a modified example of the invention, the protrusion 41 has a plurality of outwardly protruding convexities at a part of the protrusion 41 which makes contact with the electrode pad 5. By providing the plurality of convexities with the protrusion 41, concentration of electric current can be distributed to several locations. As a result, localized current concentration can be reduced. Consequently, local heat generation can be reduced in the through-hole conductor 4. Accordingly, the long-term reliability of the heater 10 can be enhanced.

Moreover, it is preferable that a plurality of convexities are formed around the outer periphery of the through-hole conductor 4. In this case, locations subjected to current concentration can be scattered over a wide area. Consequently, heat liberated by the convexities can be diffused over a wide range. As to dimensions of the convexity, for example, the height of convexity falls in the range of 0.001 to 0.07 mm. Given that the height is 0.07 mm, then the width of the convexity can be set at about 0.5 mm, for example.

Moreover, it is preferable that the surfaces of, respectively, the outer periphery and the central area of the protrusion 41 are each recessed. Expressed differently, it is preferable that a region of the surface of the protrusion 41 which region is located between the outer periphery and the central area is shaped in a frame form. The electrode pad 5 extends inside the frame-like part, thus increasing the area of contact between the protrusion 41 and the electrode pad 5. This helps reduce concentration of electric current on a certain part between the protrusion 41 and the electrode pad 5.

Figure 6:
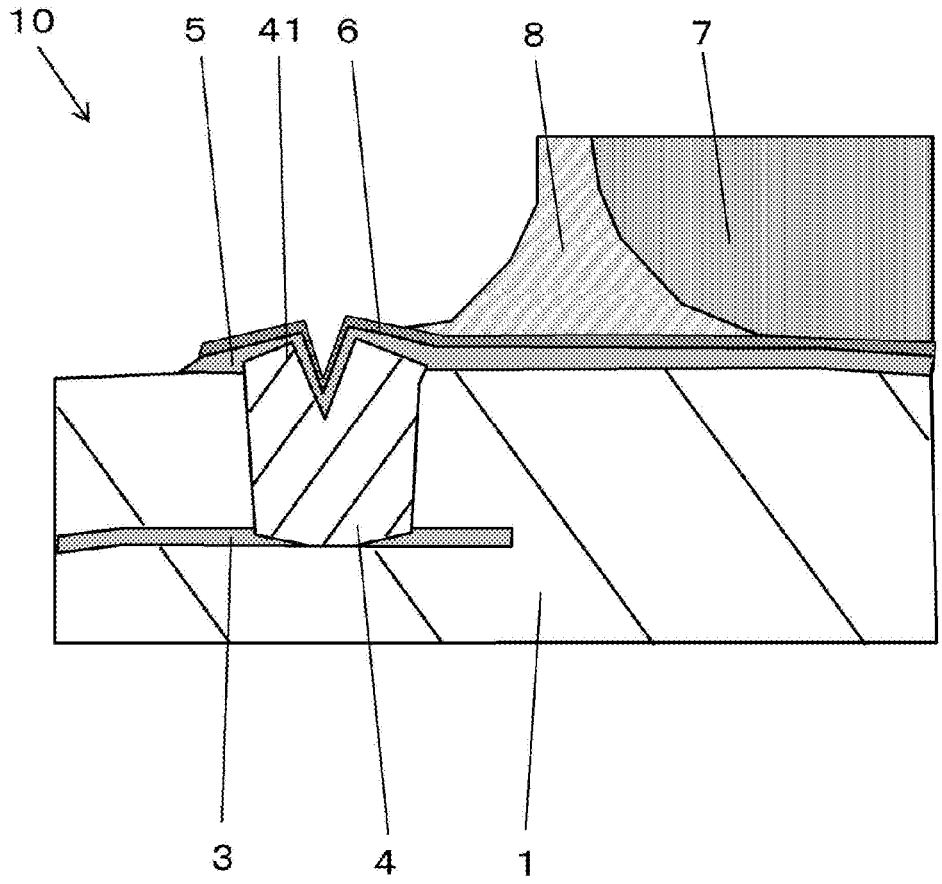
FIG. 6 is an enlarged fragmentary view of the heater according to a modified example of the invention.

Furthermore, as in the heater 10 shown in FIG. 6 according to a modified example of the invention, the through-hole conductor 4 includes the protrusion 41, and part of the surface of the through-hole conductor 4 is recessed inwardly beyond the surface of the ceramic structure 1. In this case, the area of contact between the through-hole conductor 4 and the electrode pad 5 can be further increased. This helps facilitate dissipation of heat from the through-hole conductor 4 to outside.

<Method for Manufacturing Heater 10>

Next, a method for manufacturing the heater 10 of the present embodiment will be described.

First, in order to constitute the ceramic structure 1, a sintering aid such as silicon dioxide, calcium oxide, magnesium oxide, and zirconia is blended in a ceramic component such as alumina ceramics, silicon nitride ceramics, aluminum nitride ceramics, or silicon carbide ceramics to obtain a ceramic slurry. The thereby obtained ceramic slurry is molded into a sheet form to produce ceramic green sheets. As another way, a mixture of the aforementioned constituents is subjected to a molding process such as press molding or extrusion molding to produce a plate-like or rod-like molded body.

At this time, the through-hole conductor 4 is formed for transmission of external power to the heat-generating resistor 2 through the lead terminal 7, the brazing material 8, and the nickel plating. The through-hole conductor 4 is produced by injecting an electrically conductive paste in a hole created in the ceramic green sheet. In this operation, it is important that the conductive paste is applied so that an end of the conductive paste protrudes outwardly beyond the surface of the green sheet. This end part becomes the protrusion 41 of the through-hole conductor 4 following the completion of firing.

Conductive pastes for forming the heat-generating resistor 2 and the conductor line 3, respectively, are applied to one main face of the ceramic green sheet or the molded body which constitutes the ceramic structure 1 by means of screen printing or otherwise. Moreover, a printing ink of a conductive paste for forming the electrode pad 5 is applied to the back side of the ceramic green sheet or the molded body by means of screen printing or otherwise.

The heat-generating resistor 2, the conductor line 3, and the electrode pad 5 are made of a material predominantly composed of a high-melting-point metal which can be simultaneously fired together with the ceramic structure 1, for example, tungsten, molybdenum, or rhenium.

Moreover, a conductive paste for forming the through-hole conductor 4 can be prepared by kneading a mixture of such a high-melting-point metal and appropriate amounts of other components such as a raw ceramic material, a binder, and an organic solvent.

At this time, the heat-generating position and the resistance value of the conductor line 3 are adjusted as desired in accordance with applications of the heater 10 by making changes to the length of a pattern defined in the heat-generating resistor 2-forming conductive paste, the length of a turned-back portion in the pattern, the spacing between the turned-back portions, and the line width of the pattern.

Then, the ceramic green sheet or the molded body formed with the pattern is tightly laminated on a ceramic green sheet or a molded body of identical material using a lamination liquid, thus obtaining a rod-like or plate-like molded product which constitutes the ceramic structure 1 having the heat-generating resistor 2 and conductor line 3 therein.

Next, the thereby obtained molded product is fired at a temperature of about 1500° C. to 1600° C. Moreover, a nickel plating layer 6 is applied onto the electrode pad 5 placed on the main face of the ceramic structure 1 by electrolytic plating technique. Then, the electrode pad 5 is joined to a Ni-made lead terminal 7 using silver solder as the brazing material 8. Thus, the heater 10 can be produced.

EXAMPLES

A heater 10 according to an example of the invention was produced in the following manner.

First, a ceramic green sheet which contains alumina as a major constituent, and further contains silicon dioxide, calcium oxide, magnesium oxide, and zirconia in a total amount of not greater than 10% by mass was prepared.

Next, an electrically conductive paste was prepared by mixing molybdenum powder, tungsten powder, and a binder. The conductive paste was charged into a hole created in the ceramic green sheet to make a portion which constitutes the through-hole conductor 4. At this time, the conductive paste was applied so that an end of the conductive paste protruded outwardly beyond the surface of the green sheet by about 0.05 mm. As a way to apply the conductive paste so that the end of the conductive paste protrudes outwardly beyond the surface of the green sheet, for example, the conductive paste is charged into the hole under a pressure exerted by a jig.

Then, conductive pastes predominantly composed of molybdenum and tungsten for forming the heat-generating resistor 2, the conductor line 3, and the electrode pad 5, respectively, were printed in their respective patterns to the surface of the green sheet by screen printing technique. The ceramic green sheet with printed conductive pastes was laminated to a rod-like molded product, which was molded from the same material as used for the ceramic green sheet by extrusion molding, using a lamination liquid containing dispersed ceramics of identical composition, thus obtaining a rod-like stacked body. The thereby obtained rod-like stacked body was fired in a reductive atmosphere (nitrogen atmosphere) at a temperature of about 1500 to 1600° C.

Next, a 2 to 4 μm-thick nickel plating layer was formed on the electrode pad 5 placed on the main face of the ceramic structure 1 by electrolytic plating technique. After that, the lead terminal 7 was joined to the electrode pad 5. Silver solder was used for the connection. In this way, a heater 10 of Sample 1 was produced.

In addition, a heater of Sample 2 was produced as a comparative example in which the conductive paste is present only within the hole of the ceramic structure without forming a protrusion. Otherwise, the heater of Sample 2 was constructed under the same conditions as those adopted for Sample 1.

Then, a cyclic current-feeding test has been performed on the heater 10 of Sample 1 and the heater of Sample 2 by repeating a cycle of operation involving: continuing application of DC voltage until the temperature of the surface of each sample reaches 1200° C.; and stopping the voltage application until the surface temperature drops to room temperature after the surface temperature reaches 1200° C. After that, the outer appearances of the heater 10 of Sample 1 and the heater of Sample 2 were checked. The result is that the heater 10 of Sample 1 showed no sign of cracking in the ceramic structure 1 even after the completion of 1000 cycles of current-feeding operation. On the other hand, in the heater of Sample 2, cracking occurred in the ceramic structure after the completion of about 1000 cycles of current-feeding operation. The cracking was developed from a part contiguous to the through-hole conductor.

Moreover, in each of Samples 1 and 2, the temperature of the vicinity of the through-hole conductor 4 was measured when the surface temperature of the heater reached 1200° C. More specifically, a thermocouple having a diameter of 0.1 mm was attached to a region of the electrode pad 5 which is located immediately above the through-hole conductor 4 for temperature measurement. The result is that the measured temperature in the heater 10 of Sample 1 was 238° C., whereas the measured temperature in the heater of Sample 2 was 270° C. That is, it was confirmed that, in the heater of Sample 2 devoid of the protrusion 41, heat was trapped in the through-hole conductor 4, but, in contrast, in the heater 10 of Sample 1 having the protrusion 41, heat wa readily dissipated outwardly from the through-hole conductor 4. Consequently, it was confirmed that, in the heater 10 of Sample 1, the possibility of cracking could be reduced.

REFERENCE SIGNS LIST

1: Ceramic structure
2: Heat-generating resistor
3: Conductor line
4: Through-hole conductor
41: Protrusion
5: Electrode pad
6: Plating layer
7: Lead terminal
8: Brazing material
10: Heater

The invention claimed is:

1. A heater comprising:
a ceramic structure;
a heat-generating resistor embedded in the ceramic structure;
a conductor line embedded in the ceramic structure so as to be connected to the heat-generating resistor;
a through-hole conductor disposed in the ceramic structure, one end of the through-hole conductor being connected to the conductor line and the other end of the through-hole conductor being led out to a surface of the ceramic structure; and
an electrode pad disposed on the surface of the ceramic structure so as to cover the through-hole conductor, the electrode pad being connected to the through-hole conductor, the electrode pad having a recess,
the through-hole conductor having a protrusion which protrudes outwardly beyond the surface of the ceramic structure, the protrusion having a portion extending in the recess, the portion extending in the recess of the protrusion being closely covered with the electrode pad.

2. The heater according to claim 1,
wherein the protrusion has a curved surface.

3. The heater according to claim 1,
wherein the one end of the through-hole conductor is buried into the conductor line.

4. The heater according to claim 3,
wherein the one end of the through-hole conductor connected to the conductor line has a curved surface.

5. The heater according to claim 1,
wherein the protrusion is composed of a plurality of convexities.

6. The heater according to claim 1,
wherein the through-hole conductor is cylindrically shaped.

7. The heater according to claim 1,
wherein the portion extending in the recess of the protrusion has a portion which widens gradually as the protrusion extends into the recess.

8. The heater according to claim 1,
wherein the protrusion has a recess and the electrode pad extends in the recess of the protrusion.

* * * * *